United States Patent [19]

Umehara

[11] Patent Number: 4,755,790

[45] Date of Patent: Jul. 5, 1988

[54] FLOAT SWITCH, A CONTROL APPARATUS AND A WARNING APPARATUS OF AN ENGINE

[75] Inventor: Kazuhiro Umehara, Hamamatsu, Japan

[73] Assignee: Suzuki Jidosha Kogyo Kabushiki Kaisha, Shizuoka, Japan

[21] Appl. No.: 750,962

[22] Filed: Jul. 2, 1985

[30] Foreign Application Priority Data

Jul. 4, 1984 [JP] Japan ..... 59-138816
Dec. 25, 1984 [JP] Japan ..... 59-275106

[51] Int. Cl.[4] ..... F02P 9/00

[52] U.S. Cl. ..... 340/53; 123/198 DC; 123/334; 123/335; 180/171; 340/62

[58] Field of Search ..... 340/59, 52 R, 52 F, 340/53, 60, 984, 62, 64; 73/861.75, 317, 510; 123/198 DC, 334, 340, 351, 335; 440/84, 87; 180/171

[56] References Cited

U.S. PATENT DOCUMENTS

| | | | |
|---|---|---|---|
| Re. 23,896 | 11/1954 | Higgins | 340/53 |
| 3,220,396 | 11/1965 | Heidner et al. | 123/334 |
| 3,412,609 | 11/1968 | Kaletka et al. | 73/317 |
| 3,656,101 | 4/1972 | Akeley | 340/53 |
| 3,738,346 | 6/1973 | Goodman | 340/53 |
| 4,034,335 | 7/1977 | Harazoe et al. | 340/53 |
| 4,129,040 | 12/1978 | Hayden | 340/53 |
| 4,136,329 | 1/1979 | Trobert | 340/53 |
| 4,150,356 | 4/1979 | Kosuge | 340/52 F |
| 4,336,778 | 6/1982 | Howard | 123/334 |
| 4,449,497 | 5/1984 | Wolf et al. | 123/335 |
| 4,459,951 | 7/1984 | Tobinaga et al. | 123/335 |
| 4,462,479 | 7/1984 | Steel | 123/351 |
| 4,492,197 | 1/1985 | Yamamoto et al. | 123/198 DC |
| 4,562,801 | 1/1986 | Koike | 123/198 DC |
| 4,594,978 | 6/1986 | Kanno | 123/198 DC |
| 4,641,618 | 2/1987 | Dogadko et al. | 123/335 |
| 4,664,080 | 5/1987 | Minks | 123/198 DC |
| 4,695,822 | 9/1987 | Furukawa | 340/53 |
| 4,697,560 | 10/1987 | Umehara | 123/335 |

FOREIGN PATENT DOCUMENTS

| | | |
|---|---|---|
| 55-72660 | 5/1980 | Japan . |
| 56-146011 | 11/1981 | Japan . |
| 57-10772 | 1/1982 | Japan . |
| 57-131820 | 8/1982 | Japan . |

*Primary Examiner*—Joseph A. Orsino, Jr.
*Assistant Examiner*—Brent A. Swarthout
*Attorney, Agent, or Firm*—Flynn, Thiel, Boutell & Tanis

[57] ABSTRACT

A float switch and a control apparatus of an internal combustion engine are disclosed. This float switch comprises a float attached to a main body so as to be vertically swung around one end thereof, a magnetic material fixed to the float, and a contact adapted to be closed or opened in response to the approach or removal of the magnetic material. The float switch is provided in the pathway of a coolant passage and a lubricating oil passage of the engine. The control apparatus has a warning apparatus which is operative in response to an absence signal from the float switch which is indicative of the absence of the fluid that is being sensed, and has a rotating speed control apparatus to reduce the engine speed. The absence of the fluid is informed to the operator by the warning and the speed reduction. A warning apparatus for an outboard engine to control the engine speed when an abnormality occurs is also provided. This apparatus comprises a rotating speed detecting circuit, a circuit to set the engine rotating speed in correspondence to the abnormality, and a circuit to suppress the engine speed when the detected speed exceeds a preset value. The rotating speed is also reduced when coolant is not sufficiently supplied into the water jacket or when the engine lacks oil.

17 Claims, 7 Drawing Sheets

FLOAT SWITCH, A CONTROL APPARATUS AND A WARNING APPARATUS OF AN ENGINE

BACKGROUND OF THE INVENTION

The present invention relates to a float switch of an internal combustion engine such as an outboard motor or the like and, more particularly, to a control apparatus of an internal combustion engine in which absence of a function maintaining fluid of the internal combustion engine can be positively detected by use of a small-sized, lightweight and easily attachable float switch, thereby making it possible to prevent damage of the engine.

The invention also relates to an apparatus to prevent overheating of an outboard engine and, more particularly, to a warning apparatus for detecting an occurrence of a cause of an overheating of the outboard engine and generating a warning.

In internal combustion engines, a function maintaining fluid such as cooling water, lubricating oil or the like (hereinafter referred to as a fluid) is allowed to flow through each section in order to make each section function effectively and thereby make the most of the performance of the engine.

If this fluid is lacking or does not flow through the engine, the engine will be damaged due to overheating or the like. For example, in a water-cooled outboard engine, if the coolant is not supplied to the engine due to a failure of the coolant pump or a plugging of an inlet passage for the coolant, the engine will overheat and be damaged. Or, the engine can be similarly damaged due to the lack of lubricating oil, failure of the pump for the lubricating oil, or the like.

Therefore, hitherto, causes of the occurrence of engine damage have been detected by various types of sensors to prevent engine damage. For example, a temperature sensor is attached to the cylinder head or the like of the engine and, when the engine overheats and exceeds a preset temperature, this sensor generates a signal so that the warning apparatus or control apparatus for reducing the rotating speed of the engine is made operative.

However, in such a temperature detecting system, the temperature is detected while the engine is overheating, so that it is difficult to set the temperature, and the temperature of the detecting portion changes due to various factors of the engine. Consequently, there are drawbacks such that the set temperature has to be adjusted and checked depending on the specifications of the engine, and attention must be also paid to the attaching position and attaching method, and the like.

On the other hand, there is known another system equipped with what is called a float switch in which a float member is vertically movably inserted and attached into a pipe member which is vertically disposed, and in which a limit switch is attached at the position corresponding to the level of the height of fluid to be detected; and the limit switch in the pipe member is opened or closed by means of a magnetic material attached to this float, thereby detecting the presence or absence of the fluid.

In such a conventional float switch, however, the length of pipe member has to be changed in dependence upon the height of the fluid to be detected or upon the portion where the switch is attached. In addition, since the fluid surface is detected by way of the vertical movement of the float inserted movably into the pipe member, there are drawbacks such that a long pipe member is inevitably needed for allowing the contact to be opened or closed, and the mechanism becomes large. Further, if it is intended to miniaturize the detecting mechanism by making the pipe member short, the vertical movement range of the float is narrowed, so that the opening or closing of the contact becomes difficult, causing the operation of the limit switch to become uncertain.

Therefore, in such a conventional float switch, it is difficult to make the float switch small and of light weight and to set the attaching position, so that it is difficult to realize a control apparatus which can positively detect the absence of the fluid, such as the coolant or the like, so as to prevent damage of the engine.

On the other hand, generally in water-cooled outboard engines, the cooling water is pumped up by a water pump provided in the gear casing, and this water is circulated in the jacket of the cylinder and thereafter is drained to the outside. Therefore, in the case where the inlet for the cooling water is choked or the water pump fails to operate, the cooling water is not circulated and the engine overheats, so that the cylinder and piston are damaged In addition, in the case where a propeller having a pitch smaller than the set standard value is used or a load is light even when the standard propeller is used, the rotating speed of the engine increases more than the speed as needed, so that there is a drawback such that the service life of the engine is remarkably reduced Moreover, recently many outboard engines of the separation oil supply type have been used However, in the case where the quantity of oil falls below a specified value, it is necessary to inform the operator as to the lack of oil.

The warning apparatus for an outboard engine is required because of the above-mentioned viewpoints.

As conventional warning apparatuses for an outboard engine, for example, there are known such apparatuses as disclosed in the Official Gazettes of Japanese Patent Application Laid-Open Nos. 146011/1981, 10772/1982 and 131820/1982. In these warning apparatuses, the temperature of the cylinder head portion of the engine is detected by a temperature sensor attached to the cylinder head of the engine. When the temperature exceeds a preset temperature, a buzzer or the like is made operative or the rotating speed of the engine is simultaneously controlled. In this way, the operator is warned as to the overheated state of the engine. Also, when the oil level is low, the buzzer or the like is likewise made operative, or the rotating speed of the engine is controlled.

In the foregoing conventional warning apparatuses, the set temperature of the temperature sensor attached to the cylinder head portion corresponds to a value while the temperature is increasing after the cooling water of the engine was extinguished. Thus, there is a problem such that it is difficult to select the value that is set. In other words, in dependence on the value of the set temperature, a situation such that a warning is generated in the normal operating state or the generation of the warning may occur too late. Further, means such as grease or the like is required for allowing the heat of the cylinder head to be sufficiently transferred to the temperature sensor, causing an inconvenience such that it is troublesome. In addition, it is necessary to change the set value of the temperature sensor for every engine, resulting in a drawback such that many kinds of temperature sensors having different set values are needed.

SUMMARY OF THE INVENTION

It is a first object of the present invention to provide a small-sized and lightweight float switch which can be easily attached and, more particularly, to provide a control apparatus for an internal combustion engine using such a float switch which can positively detect the absence of the function-maintaining fluid to prevent engine damage.

It is a second object of the invention to provide a warning apparatus for an outboard engine which can surely detect the abnormal state of the engine without using a temperature sensor, and can warn the operator, thereby enabling the service life of the engine to be maintained or lengthened.

The above first object is accomplished by a float switch comprising: a float attached to a main body so that the float can be vertically swung around one end thereof as a swinging center; a magnetic material fixed to the float; and a contact adapted to be closed or opened in response to the approach or departure of the magnetic material. This float switch is provided in a predetermined passage of a function-maintaining fluid, such as the coolant or lubricating oil, of an internal combustion engine. In addition, to attain the first object, there is provided a control apparatus comprising such a float switch, a warning apparatus which is made operative in response to a signal indicative of the absence of the fluid that is sensed by this float switch, and a rotating speed control apparatus for reducing the rotating speed of the engine.

According to one embodiment of the present invention, the float can be vertically swung around one end thereof as a swinging center with regard to the main body. The magnetic material fixed to the float is allowed to approach or move away from the contact due to the swinging of the float, thereby enabling the contact to be positively opened or closed.

In addition, when the float switch detects the absence of the fluid of the engine, it outputs an absence signal, thereby making the warning apparatus and rotating speed control apparatus operative. Thus, the operator can be informed as to the absence of the fluid by way of the warning and the reduction in the rotating speed.

On the other hand, the second object is accomplished by a warning apparatus of an outboard engine for controlling the operation of the engine when an abnormality occurs, comprising: a rotating speed-detecting circuit to detect the rotating speed of the engine; a rotating speed-setting circuit to set the rotating speed of the engine in correspondence to the abnormality; and a suppressing circuit to suppress the rotating speed of the engine when the detected rotating speed of the engine exceeds a predetermined value.

According to another embodiment of the invention, the rotating speed of the engine is suppressed when the detected engine speed exceeds the predetermined value, or when the coolant of the engine is not sufficiently supplied into the water jacket of the engine, or when the lubricating oil of the engine is insufficient.

The above and other objects, features and advantages of the present invention will be apparent from the following detailed description in conjunction with the accompanying drawings.

BRIEF DESCRIPTION OF THE DRAWINGS

FIGS. 1 to 9 show the first embodiment of the present invention, in which:

FIGS. 1 and 2 are respectively a side elevational view and a front view of a float switch;

FIG. 3 is a vertical sectional view in the central portion of FIG. 2;

FIG. 4 is a front end view in operation of the float switch;

FIG. 5 is a front view of a cylinder head showing an example when the float switch is used;

FIGS. 6 and 7 are side elevational views showing the operational states when the float switch is used;

FIG. 8 is a cross-sectional view showing another example when the float switch is used; and FIG. 9 is an explanatory circuit diagram of a control apparatus using the float switch.

FIGS. 10 to 13 show the second embodiment of the present invention, in which:

FIG. 10 is a circuit diagram showing one example of a warning apparatus of an outboard engine according to the invention;

FIG. 11 is a side elevational view showing one example of an outboard engine which is used in the invention;

FIG. 12 is an enlarged diagram of the portion which is seen in the direction indicated by the arrow XII in FIG. 11; and FIG. 13 is a cross-sectional view as taken along the line XIII—XIII in FIG. 12.

DETAILED DESCRIPTION OF THE PREFERRED EMBODIMENTS

An embodiment of a float switch for an internal combustion engine according to the present invention, and a control apparatus using this float switch, will now be described in detail with reference to FIGS. 1 to 9.

Figure 1:
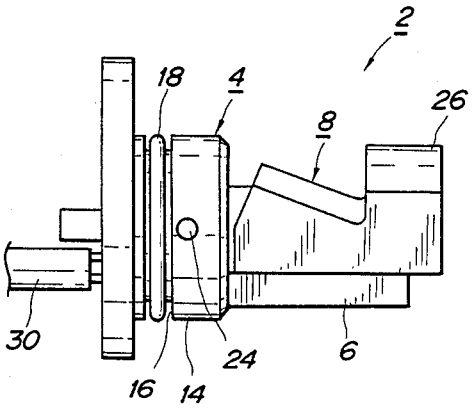
Figure 2:
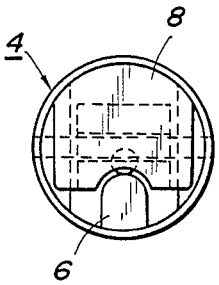
Figure 3:
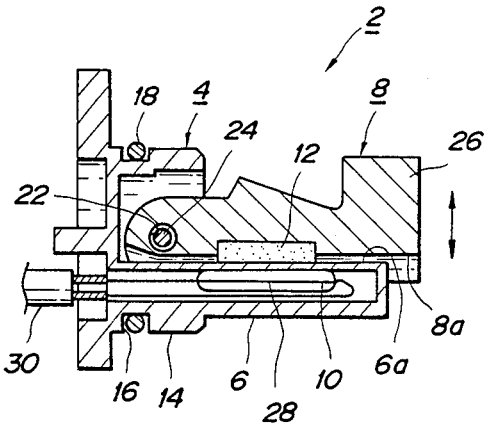
Figure 4:
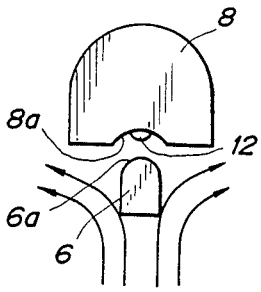
Figure 5:
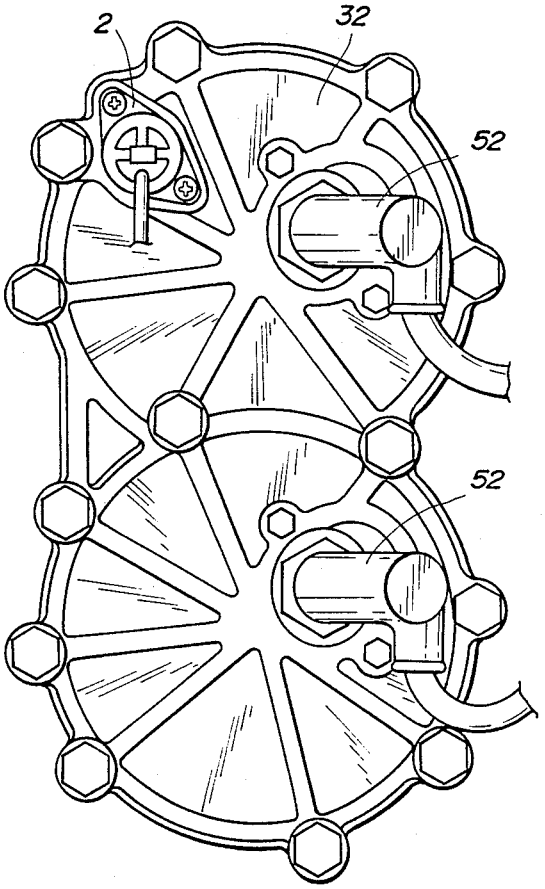

Constitution of the float switch:

FIGS. 1 to 4 show a float switch 2 of the present invention. This float switch comprises a main body 4, a projection 6, a float 8, a reed switch 10, and a magnetic member 12. The main body 4 is made of a nonmagnetic material such as a resin or the like and is constituted in such a manner that a groove 16 is formed in a cylindrical attaching portion 14, which portion 14 is attached to a cylinder head 32 (FIG. 5) as mentioned hereinafter, and an O-ring 18 is set around the groove 16. The main body 4 is provided with the cylindrical projection 6 fixed, here integral, therewith such that the projection 6 horizontally protrudes from the cylindrical attaching portion 14 to face the detecting portion such as a passage for the coolant or the like. As shown in FIGS. 2 and 4, the upper surface of the projection 6 protrudes upwardly like a convex curved surface to form a protuberance surface 6*a*. The float 8 is formed by expanding a mixture consisting of a rubber and a resin. A hole 22 serving as a swinging center is formed on one side of the float 8. A pin 24 is rotatably inserted into the hole 22 and is fixed to the attaching portion 14 of the main body 4. Thus, the float 8 is attached such that it can be freely swung so as to come into contact with or be moved away from the projection 6. A concave groove 8*a* is formed in the lower surface of the float 8 so as to be in conformity with the protuberance surface 6*a* of the projection 6. Due to this, the float 8 is positioned so as to be supported on the projection 6 when the float descends. The float 8 is formed in such a manner that the rotary end portion 26 is large and this rotary end portion 26 projects outwardly beyond the projection 6.

The reed switch 10 is positioned within the projection 6 so that the overlapping movable contact 28 extends horizontally. After the reed switch 10 is attached, it is fixed in position using a potting material and is connected to a lead wire 30. The magnetic member 12 is fixed onto the lower groove surface 8*a* of the float 8 at a position corresponding to the contact 28 so as to permit the contact 28 of the reed switch 10 to be connected or disconnected.

Figure 6:
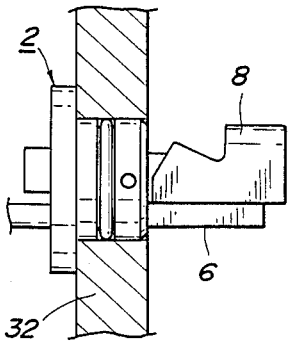
Figure 7:
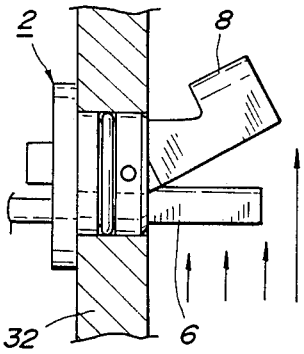
Figure 8:
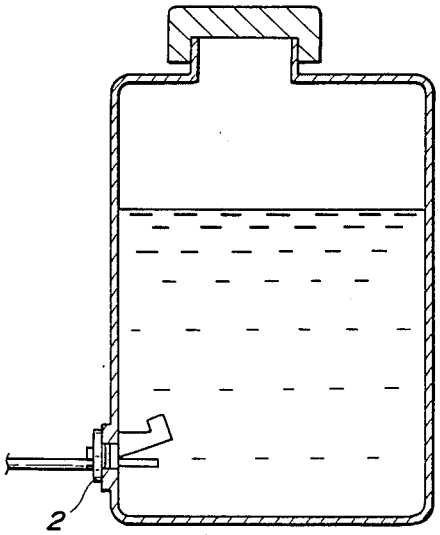

FIGS. 6 and 7 illustrate a use example of the float switch 2 in the case where the absence of the fluid of a water-cooled engine, such as an outboard engine or the like, is detected by this float switch. The attaching portion 14 of the main body 4 is attached to the cylinder head 32 such that the projection 6 projects into the coolant passage (not shown) of the cylinder head 32 with the float 2 being on the downstream side of projection 6. At this time, the attaching portion 14 and the cylinder head 32 are sealed by means of the O-ring 18 provided in the groove 16, thereby preventing leakage of the coolant. When the engine is stopped and no coolant flows, as shown in FIG. 6, the float 8 pivots downwardly into contact with the projection 6 and thereby allowing the magnetic material 12 to approach the contact 28. Thus, the contact 28 is closed and the float switch 2 is turned on. When the engine is activated and the coolant starts flowing, as shown in FIG. 7, the float 8 swings upwardly away from the projection 6 and thereby causes the contact 28 to be moved away from the magnetic material 12. Thus, the contact 28 is moved into the normally open position and the float switch 2 is turned off. The absence of the coolant can be detected by use of these "ON" and "OFF" signals. In the case where the absence of the coolant is detected, the warning apparatus or the like is made operative, thereby enabling damage of the engine to be prevented. Practically speaking, when no coolant flows after the engine is activated, the float switch is turned on. Or, when the coolant does not flow during operation of the engine, the float switch 2 is turned on. In this way, a measure for informing as to the absence of the coolant can be provided. The foregoing float switch 2 is not limited to the detection of the absence of the coolant but can obviously be used to detect, for instance, the height of the surface of the fluid such as a lubricating oil or the like as shown in FIG. 8.

As described above, the float switch 2 is constituted in such a manner that the rotary end portion 26 of the float 8 is swung vertically as indicated by arrows in FIG. 3, thereby allowing the magnetic material 12 to approach or be moved away from the contact 28, thereby permitting the contact 28 to be closed or opened. Therefore, there is no need to use the conventional pipe member into which a float is slidably inserted. Also, the whole mechanism can be made small and of light weight without causing the foregoing drawback such that the operation becomes uncertain. In addition, the attaching position of the float switch can be simply changed by easily shifting the main body 4 to an arbitrary position without changing the length of pipe member in the conventional float switch. In this case, according to this embodiment, since the rotary end portion 26 of the float 8 protrudes beyond the projection 6, upon detection of the fluid which is flowing, it is possible to prevent a drawback such that, as shown in FIG. 4, the float 8 cannot be upwardly moved because the fluid that does not hit the projection 6 also flows laterally due to the fluid which hits the projection 6 and flows laterally. In other words, the float 8 can be allowed to receive the flow pressure of the fluid by way of the projected rotary end portion 26, thereby causing the float 8 to be upwardly moved. On one hand, since the rotary end portion 26 is large, a large buoyancy is produced when the fluid exists so that the float 8 is upwardly moved. Contrarily, when no fluid exists or when the surface of the fluid is at a position lower than the location where the float switch is set, the float switch quickly descends due to the weight thereof. Thus, the operation of the float 8 can be securely performed with the aid of the positioning of the protuberance surface 6*a* of the projection 6 and of the groove surface 8*a* of the float 8, thereby allowing the opening or closing operation of the contact to be certainly performed.

If the float switch 2 is turned upside down such that the float 8 is arranged below the projection 6, this float switch can also be operated. It will be appreciated in this case that the opening and closing of the contact 28 are reversed as compared with those mentioned above.

Constitution of the control apparatus using the float switch:

A control apparatus of an internal combustion engine using the above-described float switch 2 will now be explained with reference to FIG. 9.

Figure 9:
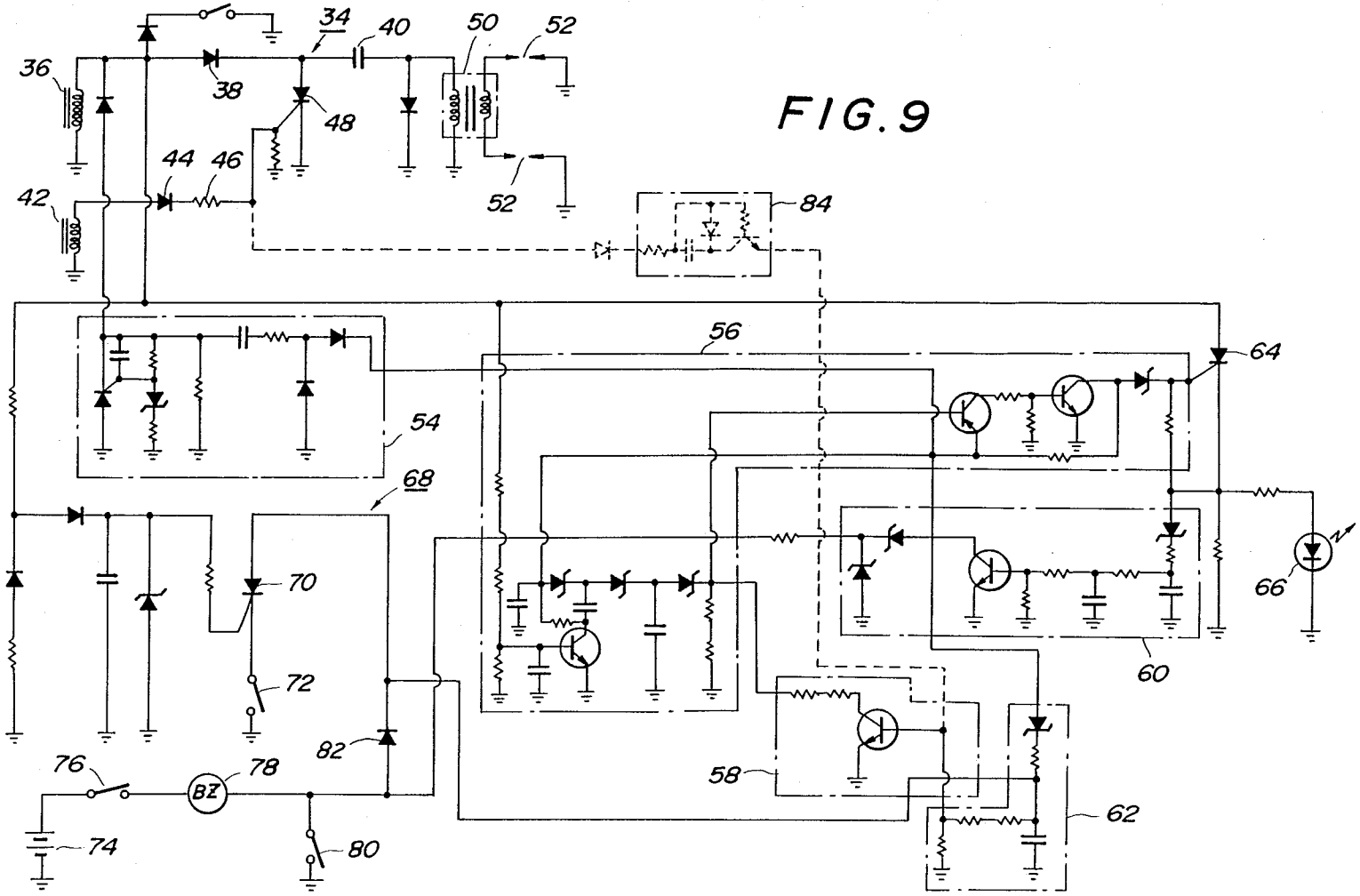

In FIG. 9, reference numeral 34 denotes a capacitive discharge ignition circuit of the magnet type. In this ignition circuit, an output which is generated in a charging coil 36 of a capacitor by means of a magnet rotor (not shown) which is rotated synchronously with a crankshaft (not shown) is charged into a capacitor 40 through a diode 38. On the other hand, an output which is generated in a pulser coil 42 flows through a diode 44 and a resistor 46 to a gate of a thyristor 48, so that the thyristor 48 is turned on. When the thyristor 48 is turned on, the charge on the capacitor 40 is discharged and a current flows through an ignition coil 50 so that a spark is caused between two spark plugs 52. A numeral 54 denotes a power supply circuit to supply a power source to each of circuits 56, 58, 60, and 62 mentioned later.

The numeral 56 is a rotating speed-detecting circuit; 58 is a rotating speed switching circuit; 60 a spark extinction detecting circuit; and 62 a timer circuit. These circuits constitute rotating speed control means. The rotating speed detecting circuit 56 receives the output of the charging coil 36 and detects the rotating speed of the engine. When the rotating speed exceeds a first set rotating speed as an over-rotating speed, the circuit 56 outputs a signal to a gate of a thyristor 64, so that this thyristor is turned on. When the thyristor 64 is turned on, the output of the charging coil 36 is short-circuited through the thyristor 64 and the capacitor 40 is not charged, so that the spark is extinguished. The output of the charging coil 36 is not inputted to the detecting circuit 56 due to this short-circuit and the thyristor 64 is turned off. Thus, the capacitor 40 is charged and the spark is generated. When the rotating speed is increased due to the generation of the spark, the detecting circuit 56 functions to extinguish the spark. The operation of the ignition circuit 34 is controlled by repeating the above-described operation and thereby allowing the engine to be operated at a speed less than the first set speed.

Generally, in the above-mentioned state, the operator can recognize the over-rotating speed due to an increase in vibration of the engine and will have tried to reduce the engine speed. However, if such a change of the engine in the operating state is small, there could be a case where the operator is not aware of the over-rotating speed and continues the operation. This state is undesirable for durability of the engine. To prevent such a situation, there are provided: the spark extinction detecting circuit 60 to detect the extinction of the spark due to the turn-on of the thyristor 64 by the rotating speed-detecting circuit 56; the timer circuit 62 which starts the operation in response to the detection signal from the circuit 60 and outputs a signal after an expiration of a predetermined time; and the rotating speed switching circuit 58 which operates in response to the signal outputted from the timer circuit 62 and switches the speed to a second set rotating speed lower than the first set rotating speed and then makes the circuit 56 operative. With such an arrangement, the engine speed is controlled to the lower second set rotating speed after an elapse of the predetermined time, thereby making it possible to actively inform the operator that the engine is rotating at an overspeed and to protect the engine. A numeral 66 denotes a light emitting diode which emits a light when the spark extinction operation is executed and thereby informs the operator for visual confirmation.

A constant voltage circuit 68 consists of a diode, a resistor, a capacitor, and a Zener diode and serves to make the output voltage of the charging coil constant. A thyristor 70 is turned on in response to an output of the constant voltage circuit 68. A first float switch 72 is connected to the cathode side of the thyristor 70, while the switching circuit 58 is connected to the anode side. The first float switch 72 is constituted as described above and is used to detect the absence of the engine coolant. This float switch is set at the uppermost position of the coolant passage.

A numeral 74 denotes a battery; 76 is an ignition switch; and 78 is a buzzer which functions as a warning means. This buzzer is connected to a second float switch 80 and to the timer circuit 62. This second float switch is also similarly constituted as mentioned above and serves to detect the absence of the engine lubricating oil in its tank or sump (not shown). The buzzer 78 is also connected to the anode side of the thyristor 70 through a diode 82.

The operation by the first float switch 72 will now be explained.

When the ignition switch 76 is turned on to start the engine, the pump is driven and starts supplying the coolant. It takes a certain time from the start of the engine until the coolant reaches the first float switch 72 disposed at the position of the uppermost level of the coolant passage. Therefore, the first float switch 72 is kept "ON" for a certain time duration after the start of the engine. On the other hand, the ignition circuit 34 is made operative not only by the turn-on of the ignition switch 76 but also generates an output at the charging coil 36 by the rotation of the magnet rotor due to the engine cranking or the like. The thyristor 70 is turned on only when it receives the output of the constant voltage circuit 68 for making the output voltage of the charging coil 36 constant. When the first float switch 72 and thyristor 70 are turned on, a current flows through the battery 74, ignition switch 76, buzzer 78, diode 82, thyristor 70, and first float switch 72, and the buzzer 78 rings. On the other hand, a part of the rotating speed switching circuit 58 is short-circuited through the thyristor 70 and first float switch 72, so that the rotating speed-detecting circuit 56 is made operative and thereby allowing the engine to be operated at the low second set rotating speed.

Therefore, upon activation of the engine, the buzzer 78 does not ring only by the turn-on of the ignition switch 76. But, when the magnet rotor is rotated due to the engine cranking or the like, the buzzer 78 rings at this time by the output of the charging coil 36. The buzzer 78 continuously rings until the coolant reaches the first float switch 72 and causes this switch to be opened and hence turned off. Simultaneously, the engine is operated at the low second set rotating speed and the light emitting diode 66 is allowed to emit the light. When the coolant reaches the first float switch 72 and this switch is turned off, the buzzer 78 stops ringing. Also, the low-speed operation at the second set speed is released and the light emitting diode 66 stops emitting the light.

Due to this, the operator knows that the coolant has not reached the first float switch 72 while the buzzer 78 is ringing after the engine is activated; therefore, he does not speed-up the engine during that period. The operator also knows that the supply of coolant is normal due to the stopping of the ringing of the buzzer. Also, he knows when he can speed-up out of the low-speed operation of the engine due to the stoppage of the light emission of the light emitting diode 66. In this way, the operator can initiate the ordinary running of the engine. With this arrangement, damage to the engine due to overheating or the like can be prevented and the engine is protected, resulting in improvement in durability. It will be understood that unless the buzzer 78 stops ringing after the start of the engine, the coolant is not normally supplied, so that the operator knows of the abnormal state.

On the other hand, in outboard engines or the like, there is a case where the operator intends to start running immediately after the start of the engine. In this case, low-speed operation at a speed less than the second set rotating speed is performed until the coolant reaches the first float switch 72, so that the rotating speed cannot be increased. Therefore, as indicated by a dotted line in FIG. 9, a second timer circuit 84 which is made operative in response to the output signal of the pulser coil 42 is separately provided. Due to this second timer circuit 84, the rotating speed switching circuit 58 is controlled so as not to be made operative until a constant time elapses after the start of the engine due to the cranking. The set time by the second timer circuit 84 is set to be slightly longer than the time which is required from the start of the engine until the coolant reaches the first float switch 72.

With this control apparatus having the second timer circuit 84, when the running is initiated immediately after the activation of the engine, the buzzer 78 rings but the engine can be operated to the high first set rotating speed. In the case where no coolant is supplied, the buzzer 78 continues to ring and after an expiration of the set time, the switching circuit 58 is made operative by the timer circuit 84, thereby allowing the engine to be operated at a low speed less than the low second set rotating speed. Due to this, the operator knows that the coolant is not being supplied normally, so that damage to the engine can be prevented by performing a measure such as stopping the engine or the like.

In the ordinary running state, when no coolant is supplied because of a failure of the pump or the like and the first float switch 72 detects the absence of the coolant and is turned on, the buzzer 78 rings and also the engine is operated at a low speed less than the low second set rotating speed by means of the switching circuit 58. Thus, the operator knows that the coolant is not supplied, and this thereby enables the damage to the engine to be prevented.

The operation by the second float switch 80 will now be described.

The second float switch 80 may be attached to the side wall of a tank (not shown) as shown in FIG. 8. This switch detects the absence of the lubricating oil in the tank and is turned on when the oil is reduced to a level below a predetermined quantity. When the lubricating oil is reduced to a level below the predetermined quantity during the running of the engine, and the second float switch 80 detects the absence of the lubricating oil and is turned on, a current flows from the battery 74 to the switch 80 so that the buzzer 78 rings. When the buzzer 78 rings, a part of the timer circuit 62 is simultaneously short-circuited through the second float switch 80. The rotating speed switching circuit 58 starts operating after an expiration of a predetermined time from the start of the operation of the timer circuit 62, thereby making the detecting circuit 56 operative for allowing the engine to be operated at a speed less than the low second set rotating speed.

As described above, when the second float switch 80 is turned on during engine running, the buzzer 78 rings first and then the engine is operated at a low speed less than the low second set rotating speed after an expiration of the predetermined time by the timer circuit 62. Thus, the operator knows that the lubricating oil is reduced to below its predetermined quantity and that damage to the engine can be prevented. In the case where the second float switch 80 is turned on during operation at a speed less than the low second set rotating speed, only the buzzer 78 rings.

If the second float switch is turned off by supplying a desired amount of lubricating oil into the engine after the reduction of the lubricating oil is detected, then the above-mentioned operation is released and the engine can be operated to the high first set rotating speed.

The operations when the absence of the coolant and the absence of the lubricating oil are respectively detected by the first and second float switches 72 and 80 are the same in that the buzzer 78 rings and the engine is operated at a low speed less than the second set rotating speed. However, since the operation sequences differ as explained later, the operator can discriminate between which absence is detected.

Practically speaking, upon starting the engine, in the case where the absence of the coolant is detected and the first float switch 72 is turned on, the ignition switch 76 is turned on and the buzzer 78 does not ring before the engine starts, but the buzzer rings when the engine starts. On the other hand, in the case where the absence of the lubricating oil is detected and the second float switch 80 is turned on at the start of the engine, the buzzer 78 rings when the ignition switch 76 is merely turned on but before the engine starts.

In the case where the first float switch 72 detects the absence of the coolant and the engine is turned on in its ordinary running state, the buzzer 78 rings and simultaneously the engine may be operated at a low speed less than the second set rotating speed. When the second float switch 80 detects the absence of the lubricating oil and the engine is turned on, the buzzer 78 first rings and after an expiration of the predetermined time, the engine may be operated at a low speed less than the second set rotating speed.

Consequently, it is possible to easily discriminate which absence, coolant or lubricating oil, is detected.

As described above, according to the float switch of the invention, the float vertically swings with regard to the main body around one side thereof as a swinging central point. Due to the swing of this float, the fixed magnetic material is allowed to approach or be moved away from the contact, and the contact can be certainly closed or opened. Thus, there is no need to use a conventional long pipe member into which the float is vertically movably inserted, and the mechanism can be made small and of light weight. Also, the attaching position can be simply changed by merely shifting the main body to an arbitrary location.

In addition, according to the control apparatus of the internal combustion engine using the float switch of the invention, when the absence of the fluid is detected, the warning means and rotating speed control means are made operative in response to the absence signal, thereby informing the operator of the absence of the fluid by means of a warning and a reduction in rotating speed of the engine, so that the damage of the engine can be prevented.

Next, an embodiment of a warning apparatus for an outboard engine according to the present invention will be described hereinbelow with reference to FIGS. 10 to 13.

Figure 10:
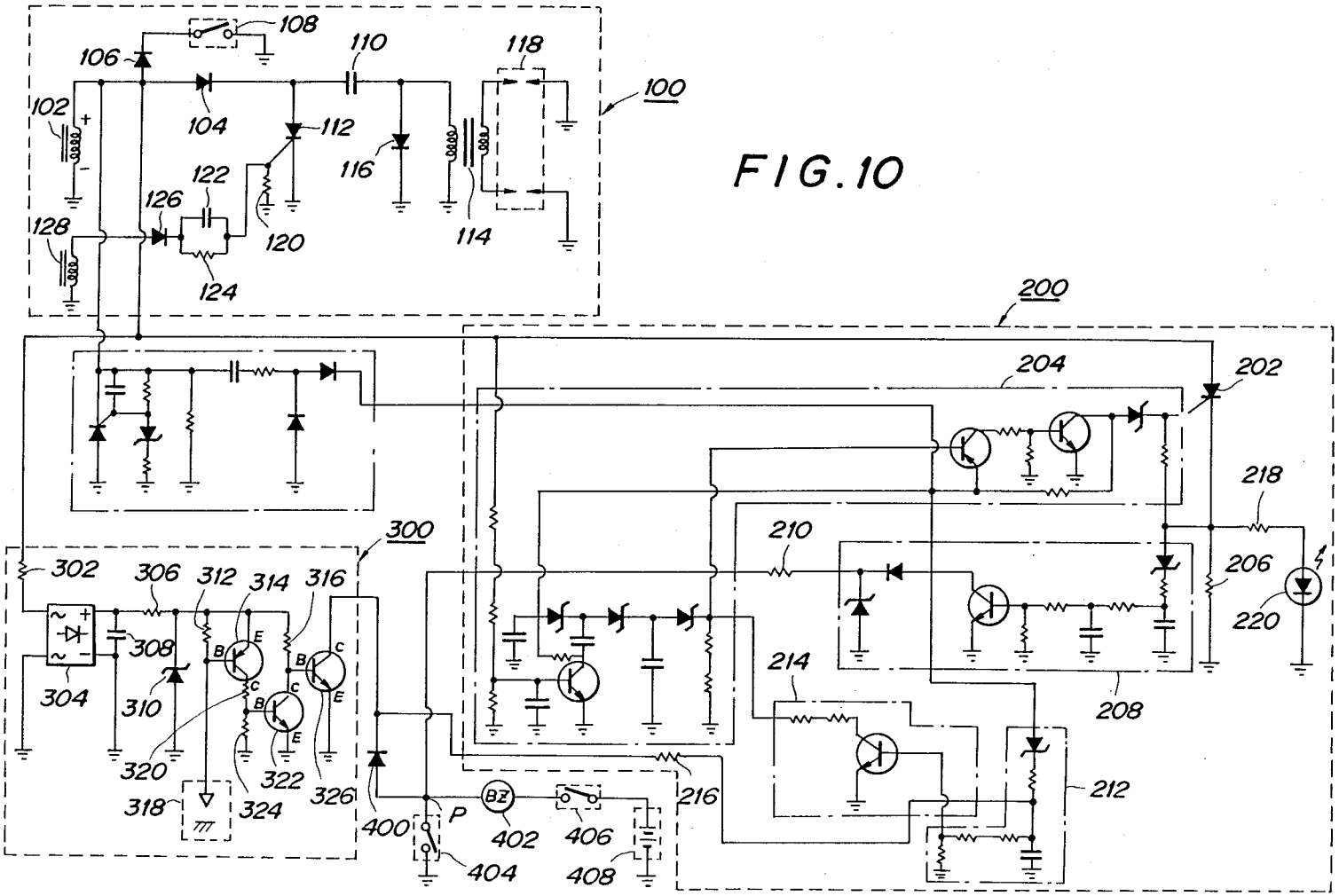

FIG. 10 shows one embodiment of the warning apparatus according to the invention.

Constitution of the ignition apparatus:

In FIG. 10, a CDI (Capacitive Discharge Ignition) apparatus 100 is constituted in a similar manner as in a circuit which is generally known. One end of a capacitive charging coil 102 is connected to the ground and the other end is connected to the anode sides of diodes 104 and 106, respectively. The cathode side of the diode 106 is connected to the ground through a stop switch 108. On one hand, the cathode side of the diode 104 is connected to a capacitor 110 and an anode of a thyristor 112, respectively. The capacitor 110 is connected to one end of the primary coil of an ignition coil 114. The other end of this primary coil and the cathode side of the thyristor 112 are connected to the ground. A diode 116 is also connected in parallel to this primary coil. The secondary coil of the ignition coil 114 is connected to a spark plug 118. A gate of the thyristor 112 is connected to the ground through a resistor 120 and is also connected to the cathode side of a diode 126 through a parallel circuit consisting of a capacitor 122 and a resistor 124. Further, the anode side of the diode 126 is connected to the ground through a pulser coil 128.

Operation of the ignition apparatus:

The operation of the CDI apparatus 100 constituted as described above will now be described. When a flywheel is first rotated synchronously with a crankshaft (not shown), an electromotive force is generated in the capacitive charging coil 102. Due to this electromotive force, a current flows through the closed circuit formed by the diode 104, capacitor 110, diode 116, and ground, so that the capacitor 110 is charged.

Similarly, when the flywheel is rotated, an electromotive force is also generated in the pulser coil 128. Due to this electromotive force, a current flows through a bias circuit consisting of the diode 126, capacitor 122 and resistor 124 to the closed circuit formed by the resistor 120 and ground, so that a voltage is applied to the gate of the thyristor 112. When the gate voltage of the thyristor 112 due to the resistor 120 reaches the trigger voltage of the thyristor 112, the thyristor 112 is switched from the "OFF" state to the "ON" state.

Thus, the charges stored in the capacitor 110 are discharged by way of the circuit formed by the thyristor 112 and primary coil of the ignition coil 114. Therefore, a current flows to the primary coil of the ignition coil 114 and further a high voltage is generated in the secondary side of the ignition coil 114, and this high voltage is applied to the spark plug 118, thereby causing the ignition. The foregoing operation is performed at every rotation of the flywheel and the engine is continuously operated. When the stop switch 108 is turned on, the charging coil 102 is short-circuited through the diode 106, stop switch 108 and ground, so that the capacitor 110 is not charged. Therefore, the ignition of the spark plug 118 is not performed.

Constitution of the overspeed preventing apparatus:

An overspeed preventing apparatus 200 will now be explained. The plus side of the foregoing capacitive charging coil 102 is connected to the anode side of a thyristor 202 serving as a suppression means. A rotating speed-detecting circuit 204, serving as a rotating speed-detecting means and suppression means, is connected to the anode side and gate side of the thyristor 202. On the other hand, the cathode side of the thyristor 202 is connected to the ground through a resistor 206 and is also connected to a spark extinction detecting circuit 208. The detecting circuit 208 is further connected to a buzzer 402 through a resistor 210 and is also connected to a rotating speed switching circuit 214 serving as rotating speed setting means through a timer circuit 212. The switching circuit 214 is connected through a resistor 216 to a collector of a transistor 326 in a coolant detecting apparatus 300 explained hereinafter. The cathode side of the thyristor 202 is connected to a light emitting diode 220 through a resistor 218. The diode 220 is further connected to the ground. The resistor 218 and light emitting diode 220 are provided to inform the operator of the outboard engine that the engine is in the overspeed preventing state, namely, the spark extinction state, and they are connected as necessary.

Constitution of the coolant detecting apparatus:

The coolant detecting apparatus 300 will now be explained. The plus side of the coil 102 is connected to one of AC side terminals of a rectifier 304 through a resistor 302. Another AC side terminal of the rectifier 304 is connected to the ground. An output terminal on the plus side of the rectifier 304 is connected through a resistor 306 to the cathode side of a Zener diode 310, one end of a resistor 312, an emitter of a transistor 314, and one end of a resistor 316, respectively. In addition, a capacitor 308 is connected between the output terminals of the plus and minus sides of the rectifier 304. The minus side output terminal is connected to the ground. Further, the anode side of the Zener diode 310 is also connected to the ground.

The other end of the resistor 312 is connected to a base of the transistor 314 and is also connected to a coolant sensor 318. A collector of the transistor 314 is connected to a base of a transistor 322 through a resistor 320 and is further connected to the ground through a resistor 324. An emitter of the transistor 322 is also connected to the ground. The other end of the resistor 316 is connected to a collector of the transistor 322 and a base of the transistor 326, respectively. An emitter of the transistor 326 is connected to the ground.

In the foregoing circuit arrangement, the smoothing circuit to smooth an output waveform of the rectifier 304 is constituted by the resistor 306 and capacitor 308. The Zener diode 310 serves to make the smoothed DC voltage constant. Further, the resistors 312, 316, 320, 324 and transistors 314, 322, 326 constitute the amplifier to amplify an output of the coolant sensor 318.

The collector of the transistor 326, which serves as an output terminal of the foregoing amplifier, is connected to the cathode side of a diode 400. The anode side of the diode 400 is connected to one end of the buzzer 402 and is also connected to one end of an oil level switch 404 having an oil level detecting function. The other end of the oil level switch 404 is connected to the ground. The other end of the buzzer 402 is connected to the plus side of a battery 408 through an ignition switch 406. The minus side of the battery 408 is connected to the ground.

Figure 11:
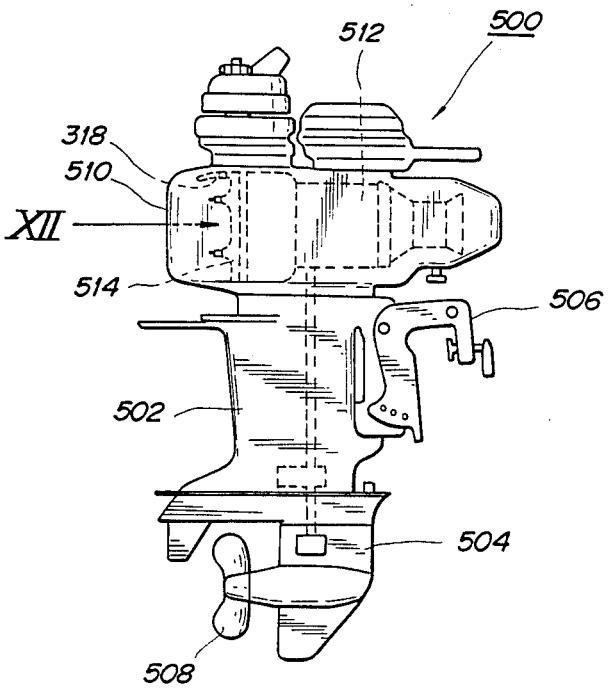
Figure 12:
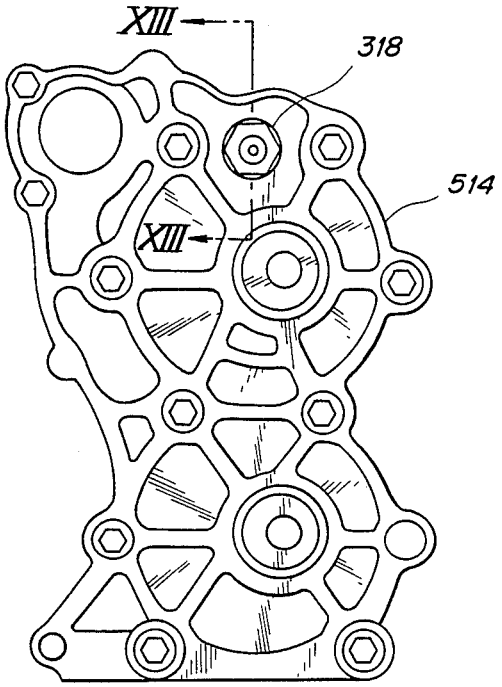
Figure 13:
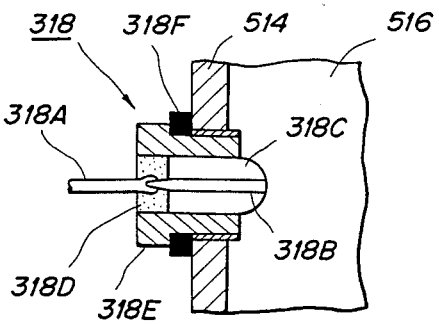

Constitution of the coolant sensor:

The foregoing coolant sensor 318 will now be explained in detail with reference to FIGS. 11 to 13. In these drawings, an outboard engine 500 has an upper casing 502 and a lower casing 504. The upper casing 502 is attached to a transom of a ship (not shown) through a clamp bracket 506. A propeller 508 is attached to the lower casing 504.

The upper opening of the upper casing 502 is covered by an engine cowling 510 and an engine 512 is enclosed in this cowling. The coolant sensor 318 is attached to a cylinder head cover 514 of the engine 512. As shown in FIG. 13, the coolant sensor 318 has a structure such that an electrode 318B made of aluminum or the like connected to a lead wire 318A is arranged at the center. First, the electrode 318B is enclosed in an electrode holder 318C made of heat-resisting glass in such a manner that the front end portion is located inside of a water jacket 516 of the engine 512. On one hand, the rear end portion of the electrode 318B is exposed from the electrode holder 318C and this exposed portion is connected to the lead wire 318A. This connecting portion is fixed by means of a filler material 318D. Further, the electrode holder 318C is enclosed in a body 318E consisting of an insulation material such as a resin or the like. The body 318E is fixed to the uppermost portion or the portion near the top of the cylinder head cover 514 through a packing 318F for increasing the sealing effect.

Overall operation of this embodiment:

The overall operation of the foregoing embodiment will now be explained.

Overspeed preventing operation:

The operation to prevent the overspeed of the engine 512 will first be explained. Generally, in the case where the propeller 508 is smaller than the specified size, then cavitation occurs during running, or when the ship to which this outboard engine is attached is of relatively light weight, a phenomenon is caused such that the rotating speed of the engine 512 abnormally increases. In this embodiment, if the rotating speed of the engine 512 is likely to exceed a predetermined speed, the rotation of the engine 512 is controlled by suppressing the ignition of the spark plug 118, thereby preventing the overspeed of the engine 512.

The rotating speed of the engine 512 is detected by the rotating speed detecting circuit 204. Namely, the pulselike electromotive force is generated from the capacitive charging coil 102 and the period of this pulse is concerned with the rotating speed of the engine 512. The electromotive force of the coil 102 is inputted to the detecting circuit 204 and the rotating speed is detected by way of this electromotive force.

When the rotating speed is below a set value, no signal is outputted from the detecting circuit 204 to the gate of the thyristor 202. Therefore, the thyristor 202 is in the "OFF" state. Thus, the overspeed preventing apparatus 200 does not operate and the ignition apparatus 100 continues operation as mentioned above.

Next, when the rotating speed of the engine 512 increases and reaches the set value due to either of the above-mentioned reasons, a signal is outputted from the detecting circuit 204 to the gate of the thyristor 202. Thus, the thyristor 202 is turned on and the plus side of the charging coil 102 is connected to the ground through the resistor 206. Due to this, the capacitor 110 is not charged. Therefore, even if the thyristor 112 is turned on, no current flows through the primary coil of the ignition coil 114 and the ignition of the spark plug 118 is not performed. This results in reduction in rotational speed of the engine 512.

However, when the rotating speed of the engine 512 decreases and falls below the set value, the gate signal output from the detecting circuit 204 is stopped, so that the capacitor 110 is again charged and the ignition of the spark plug 118 is performed.

Consequently, so far as the foregoing causes to increase the rotating speed of the engine 512 are not eliminated, the above-mentioned operation is repeated, causing a variation in speed of the engine near the set value as a center.

The vibration of the engine 512 increases more than the ordinary due to the foregoing reason, and the operator could have an unpleasant feeling. In such a situation, the operator generally intends to return a throttle valve (not shown) and thereby reducing the rotating speed to below the set value. However, in the case where there is hardly a difference in vibrational feeling between the oscillating state and the ordinary state of the engine, this oscillating state could be maintained. However, since the engine 512 is repeating the ignition and spark extinction states, there is a drawback such that the engine vibration frequently occurs and the service life of the engine is reduced. To prevent such a drawback, the spark extinction detecting circuit 208 is provided.

In more detail, when the rotating speed of the engine 512 increases and reaches the set value and the engine enters the spark extinction state, this state is detected by the detecting circuit 208, so that the detecting circuit 208 is set into the "ON" state. This detection is made by checking the state of the cathode side of the thyristor 202. Next, a signal indicative of the "ON" state is outputted from the detecting circuit 208 to the timer circuit 212, so that the timer circuit 212 starts a predetermined time. After completion of the timing of the predetermined time, the rotating speed switching circuit 214 is made operative, so that the set value of the rotating speed which has been set in the detecting circuit 204 is switched from a first value to a second value. Namely, when the rotating speed first reaches the first value (for instance, 6000 rpm), the engine enters the spark extinction state, thereby allowing the rotating speed of the engine 512 to be restricted. When this state continues, the set value of the rotating speed is switched to the second value (e.g., 3000 rpm) after an expiration of a predetermined time (e.g., a few seconds). Thus, the rotating speed of the engine is reduced to the second value and the continuous operation at the first set value is prevented. When the operator returns the throttle valve and the rotating speed of the engine is reduced to below the second value, the operation of the engine at the second value is released, so that the ordinary operation can be executed.

In the foregoing operation, since the thyristor 202 is "ON" in the spark extinction state, a current flows through the resistor 218 to the light emitting diode 220, so that the diode 220 emits the light. In other words, when the rotating speed of the engine 512 exceeds the set value, the light emitting diode 220 is lit so that the operator can easily know of the overspeed state.

Detecting operation of the coolant:

Next, the detecting operation for the coolant of the engine 512 will be explained. First, when the ignition switch 406 is turned on to activate the engine 512, the output of the charging coil 102 is rectified by the rectifier 304 and is converted to a DC output. Further, this output is smoothed by the smoothing circuit consisting of the capacitor 308 and resistor 306 and this output voltage is made constant by the Zener diode 310.

On one hand, the coolant is pumped by a pump (not shown) due to the activation of the engine 512; however, it takes a short time until the coolant reaches the upper portion of the water jacket 516, namely, the position of the coolant sensor 318. During this time, the resistance between the electrode 318B of the coolant sensor 318 and the ground, i.e., the cylinder head cover 514, is almost infinite. Therefore, the base current of the transistor 314 does not flow, so that the transistor 314 is turned off. The transistor 322 is also turned off since no base current flows.

However, since the transistor 326 is of the NPN type, the output voltage of the rectifier 304 is applied through the resistors 306 and 316, so that the transistor 326 is turned on. The closed circuit is formed by the transistor 326, diode 400, buzzer 402, ignition switch 406, battery 408, and ground, so that current flows through the buzzer 402 and this buzzer rings.

Further, when the transistor 326 is conductive, its collector is substantially at the earth potential and this potential is detected by the switching circuit 214 through the resistor 216. The rotating speed of the engine 512 is set to the second value by the switching circuit 214. Thus, the engine 512 is rotated at a speed below the second set value.

After a constant time, e.g., a few seconds has elapsed, the coolant rises into the upper portion of the water jacket 516 and soon reaches the position of the coolant sensor 318. The resistance between the electrode 318B of the sensor 318 and the cylinder head cover 514, i.e., the ground, is reduced and becomes a value of, e.g., about hundreds of ohms. Thus, the base potential of the transistor 314 drops and this transistor is turned on. That is, a current flows through the emitter and base of the transistor 314 and coolant sensor 318. The transistor 322 is also turned on and a current flows through the base and the collector becomes almost equal to the earth potential, thereby causing the transistor 326 to be turned off, so that the current supply to the buzzer 402 is stopped and the buzzer stops ringing.

At the same time, the increase in collector potential of the transistor 326 is detected by the switching circuit 214 and the set value in the detecting circuit 204 is switched from the second value to the first value, so that the ordinary engine operation can be performed.

That is, when the engine 512 is activated, the buzzer 402 rings and the rotating speed of the engine is suppressed to the second value. This operational state continues until the level of the coolant in the water jacket 516 reaches the sensor 318. When the coolant reaches the sensor 318, the buzzer 402 stops ringing and the rotating speed of the engine 512 is set to the first value.

Consequently, the operator can audibly check whether or not the coolant is supplied to the cylinder of the engine 512 by the ringing of the buzzer 402. In addition, since the rotating speed of the engine 512 is suppressed until the coolant is sufficiently supplied into the water jacket 516, the engine 512 can be protected.

Subsequently, if the coolant is not supplied to the cylinder during the running of the engine due to some reason, the level of the coolant in the water jacket 516 drops and the resistance value between the sensor 318 and the ground increases and the buzzer 402 rings due to the foregoing operation, and at the same time the rotating speed of the engine 512 is suppressed to the second value and the spark plug 118 is placed in the spark extinction state. Thus, the abnormal state of the coolant is informed to the operator and the engine 512 is protected. In this case, the light emitting diode 220 is also lit, thereby enabling the operator to visually know the abnormal state.

Further, when such a cause of the abnormal state of the coolant is solved, the level of the coolant again rises to the position of the coolant sensor 318 and the buzzer 402 stops ringing due to the foregoing operation and the engine 512 returns to its normal operating state. Since each electric power consumption of the overspeed preventing apparatus 200 and coolant detecting apparatus 300 is very small, the operation of the CDI apparatus 100 is not influenced by the above-mentioned operation.

Operation in the oil warning:

The operation in the oil warning system will now be described. The oil level switch 404 is attached in the oil tank of the engine 512 and is turned off when the amount of the oil is over a specified value, while it is turned on when the oil amount is below the specified value.

Now, assuming that the oil amount becomes below the specified value during engine running and the oil level switch 404 is turned on, a current is supplied from the power source 408 to the buzzer 402 and the buzzer 402 rings. On the other hand, the ON-operation of the switch 404 is detected by the timer circuit 212 as a change in potential at a node P, so that the timer circuit 212 starts the foregoing predetermined timing. After completion of this timing operation, the set value in the rotating speed detecting circuit 204 is switched from the first value to the second value by the switching circuit 214 as mentioned above, so that the rotating speed of the engine 512 is suppressed. As the result of these operations, the operator is warned as to the lack of the proper oil level, and the engine 512 is protected.

The operation upon a low oil level warning and the operation when the coolant is abnormal are similar with regard to the points that the buzzer 402 rings and the rotating speed of the engine 512 is suppressed. However, the buzzer ringing and speed suppressing operations are almost simultaneously executed when the coolant is abnormal. On the other hand, at the time of a low oil level warning, the rotating speed of the engine 512 is suppressed after expiration of a predetermined time, e.g., a few seconds after the buzzer 402 rings. Therefore, the operator can discriminate from such difference which abnormal state, i.e., coolant or lubricating oil, occurs.

As described above, according to this embodiment, since the power source of the coolant detecting apparatus 300 is derived from the electromotive force of the capacitive charging coil 102, the invention can be applied as well to an engine using no battery. In addition, since the buzzer 402 rings continuously until the coolant is sufficiently supplied after the activation of the engine, the cooling function can be checked beforehand. Also, since the timer circuit for prevention of overspeed and the timer circuit to control the rotating speed for the oil warning are commonly used, the circuit arrangement is simple. Further, there are effects such that it is possible to distinguish between the abnormal state of the coolant and the oil warning from the difference between the operation times of the buzzer ringing and of the speed control, and thus the reduction in the service life of the engine can be prevented.

Although the denominations of "plus side" and "minus side" were used for the coils 102 and 128 in the description of the above embodiment, these words are used for easy understanding and do not denote that the electromotive forces of the coils 102 and 128 are DC powers.

As explained above, according to this embodiment, the warning apparatus of an outboard engine which controls the operation of the engine when an abnormality occurs comprises: rotating speed detecting means for detecting a rotating speed of the engine; rotating speed setting means for setting the rotating speed of the engine in corresponding to an abnormality; and suppressing means for suppressing the rotating speed of the engine when the detected rotating speed of the engine exceeds a preset value. Therefore, there are effects such that the overheating of the engine can preferably be prevented with regard to various kinds of abnormal conditions, and that the reduction of the service life of the engine can be prevented.

Although the present invention has been shown and described with respect to preferred embodiments, various changes and modifications which are obvious to a person skilled in the art to which the invention pertains are deemed to lie within the spirit and scope of the invention.

What is claimed is:

1. A warning apparatus for controlling the operation of an outboard engine when an abnormality occurs, comprising:

rotating speed detecting means for monitoring the rotating speed of said engine; and rotating speed setting means responsive to said rotating speed detecting means for limiting the rotating speed of said engine when said engine is attempting to exceed a first predetermined speed, said rotating speed setting means limiting the speed of said engine to said first predetermined speed for a predetermined interval of time while said engine is attempting to exceed said first predetermined speed and there-after limiting the speed of said engine to a second predetermined speed which is less than said first predetermined speed;

wherein said engine includes a spark plug and capacitive discharge ignition means coupled to said spark plug for periodically applying to said spark plug an electrical voltage pulse which causes said spark plug to produce a spark;

wherein said rotating speed setting means includes selectively actuable suppression means for inhibiting the application of selected said electrical voltage pulses to said spark plug in order to effect said limiting of the rotating speed of said engine;

wherein said rotating speed setting means further includes spark extinction detecting means for producing a signal indicating that said suppression means is inhibiting electrical voltage pulses in order to limit the rotating speed of said engine, timer means responsive to said spark extinction detecting means for measuring said predetermined interval of time after said spark extinction detecting means produces said signal, and rotating speed switching circuit means responsive to said timer means for causing said suppression means to selectively inhibit the application to said spark plug of more of said electrical voltage pulses in order to effect said limiting of the rotating speed of said engine to said second predetermined speed;

wherein said capacitive discharge ignition means includes a charging coil having an output and means for producing each said electrical voltage pulse from electrical energy produced by said charging coil at said output thereof;

wherein said selectively actuable suppression means includes a thyristor having an anode connected to said output of said charging coil and having a cathode connected through a first resistance to ground;

wherein said rotating speed setting means includes: a first transistor having a collector, having an emitter connected to ground, and having a base connected through a second resistance to said output of said charging coil; a third resistance connected between said base of said first transistor and ground; a first capacitor connected between said base of said first transistor and ground; a fourth resistance connected between said collector of said first transistor and an anode of a first zener diode; a second capacitor connected between said anode of said first zener diode and ground; a third capacitor connected between said collector of said first transistor and a cathode of said first zener diode; a second zener diode having an anode connected to said cathode of said first zener diode; a fourth capacitor connected between a cathode of said second zener diode and ground; a third zener diode having an anode connected to said cathode of said second zener diode; a fifth resistance connected between a cathode of said third zener diode and ground; a second transistor having a collector, having a base connected to said cathode of said third zener diode, and having an emitter connected to said anode of said first zener diode and to a source of power; a third transistor having a collector, having a base, and having an emitter connected to ground; a sixth resistance connected between said collector of said second transistor and said base of said third transistor; a seventh resistance connected between said base of said third transistor and ground; a fourth zener diode having an anode connected to said collector of said third transistor and having a cathode connected to a gate of said thyristor; and an eighth resistance connected between said gate and said cathode of said thyristor; and wherein said rotating speed switching circuit means has an output connected to said cathode of said third zener diode.

2. The warning apparatus according to claim 1, including means for producing a further signal when insufficient coolant is supplied to a water jacket of said engine, and wherein said rotating speed setting means promptly limits the rotating speed of the engine to said second predetermined speed in response to said further signal.

3. The warning apparatus according to claim 1, including means for producing a further signal when the level of a lubricating oil in the engine drops below a predetermined level, and wherein said rotating speed setting means limits the rotating speed of the engine to said second predetermined speed in response to said further signal indicating the lubricating oil of the engine is below said predetermined level.

4. The warning apparatus according to claim 1, including switch means for producing a signal when the level of a lubricating fluid in said engine drops below a predetermined level, and wherein said timer means is responsive to said switch means for measuring said predetermined interval of time after the start of said signal from said switch means, said rotating speed switching means being responsive to said timer means for causing said rotating speed setting means to limit the rotating speed of said engine to said second predetermined value when said timer means indicates said signal from said switch means has continued for said predetermined interval of time.

5. The warning apparatus according to claim 1, including first switch means for producing a first signal when insufficient coolant is supplied to a water jacket of said engine and second switch means for producing a second signal when the level of a lubricating fluid in the engine drops below a predetermined level, and including means for producing an operator perceptible warning in response to one of said first and second signals, said means for producing an operator perceptible warning being one of a buzzer and a light emitting diode.

6. The warning apparatus according to claim 5, wherein said means for producing an operator perceptible warning includes timer means for preventing the production of an operator perceptible warning in response to said first signal for a predetermined interval of time following starting of said engine.

7. The warning apparatus according to claim 1, including means responsive to said rotating speed setting means for energizing a light emitting diode whenever said rotating speed setting means is limiting the speed of the engine to one of said first and second predetermined speeds.

8. A warning apparatus according to claim 1, wherein such spark extinction detecting means includes: a fifth zener diode having an anode connected to said cathode of said thyristor; a fifth capacitor having a first end connected to ground and a second end connected through a ninth resistance to a cathode of said fifth zener diode; a sixth capacitor having a first end connected to ground and a second end connected through a tenth resistance to said second end of said fifth capacitor; a fourth transistor having a collector, having an emitter connector to ground, and having a base connected through an eleventh resistance to said second end of said sixth capacitor; a twelfth resistane connected between said base of said fourth transistor and ground; a sixth zener diode having an anode connected to said collector of said fourth transistor; and a seventh zener diode having an anode connected to ground and a cathode connected to said cathode of said sixth zener diode; and wherein said rotating speed setting means further includes a first diode element having a cathode connected to an input of said timer means and having an anode connected through a thirteenth resistance to said cathode of said sixth zener diode.

9. The warning apparatus according to claim 8, wherein said timer means includes an eighth zener diode having an anode cconnected to said source of power; a fourteenth resistance connected between a cathode of said eighth zener diode and said cathode of said first diode element; a seventh capacitor having a first end connected to ground and a second end connected to said cathode of said first diode element; a fifteenth resistance connected between said second end of said seventh capacitor and an output of said timer means; and a sixteenth resistance connected between said output of said timer means and ground; said output of said timer means being connected to an input of said rotating speed switching circuit means.

10. The warning apparatus according to claim 9, wherein said rotating speed switching circuit means includes: a fifth transistor having a collector, having an emitter connected to ground, and having a base connected to said output of said timer means; and a seventeenth resistance connected between said collector of said fifth transistor and said cathode of said third zener diode.

11. The warning apparatus according to claim 10, further comprising a power supply circuit which includes: a further thyristor having a gate, having an anode connected to ground, and having a cathode coupled to said output of said charging coil; an eighth capacitor connected between said cathode and said gate of said further thyristor; an eighteenth resistance connected between said cathode and said gate of said further thyristor; a ninth zener diode having an anode connected to said gate of said further thyristor; a nineteenth resistance connected between ground and a cathode of said ninth zener diode; a twentieth resistance connected between said cathode of said further thyristor and ground; a ninth capacitor having a first end connected to said cathode of said further thyristor and having a second end; a second diode element having an anode connected to ground; a twenty-first resistance connected between said second end of said ninth capacitor and a cathode of said second diode element; and third diode element having an anode connected to said cathode of said second diode element and having a cathode, said cathode of said third diode being said source of power.

12. The warning apparatus according to claim 10, including: normally open oil level switch means connected between ground and said anode of said first diode element, said oil level switch means being closed when the level of a lubricating oil in the engine drops below a predetermined level; a buzzer having a first end connected to said anode of said first diode element and having a second end; a battery having a first end connected to ground and having a second end; and an ignition switch connected between said second end of said battery and said second end of said buzzer.

13. The warning apparatus according to claim 12, including: a second diode element having a cathode connected through an eigtheenth resistance to said output of said charging coil and having an anode connected through a nineteenth resistance to ground; a third diode element having an anode connected to said cathode of said second diode element; an eighth capacitor connected between ground and a cathode of said third diode element; a ninth zener diode having an anode connected to ground and a cathode connected to said cathode of said third diode element; a further thyristor having a gate connected through a twentieth resistance to said cathode of said third diode element, having an anode connected to said cathode of said first diode element, and having a cathode; and normally open coolant level switch means connected between ground and said cathode of said further thyristor, said coolant switch means being closed in response to the cessation of a flow of coolant through the engine.

14. The warning apparatus according to claim 12, including: rectifier means having a first input connected to ground, having a second input connected through an eighteenth resistance to said output of said charging coil, having a first output connected to ground, and having a second output; an eighth capacitor connected between said first and second outputs of said rectifier means; a ninth zener diode having an anode connected to ground and a cathode connected through a nineteenth resistance to said second output of said rectifier means; a coolant sensor disposed in a coolant passage of the engine and having electrically isolated first and second electrodes in contact with the coolant, said first electrode being grounded and said second electrode being connected through a twentieth resistance to said cathode of said ninth zener diode; a sixth transistor having an emitter connected to said cathode of said ninth zener diode, having a base connected to said second electrode of said coolant sensor, and having a collector; a seventh transistor having an emitter connected to ground, having a collector connector through a twenty-first resistance to said cathode of said ninth zener diode, and having a base connected through a twenty-second resistance to said collector of said sixth transistor; a twenty-third resistance connected between ground and said base of said seventh transistor; and an eighth transistor having an emitter connected to ground, a base connected to said collector of said seventh transistor, and a collector connected to said cathode of said first diode element.

15. A warning apparatus for controlling the operation of an outboard engine when an abnormality occurs, comprising:

rotating speed detecting means for monitoring the rotating speed of said engine; and rotating speed setting means responsive to said rotating speed detecting means for limiting the rotating speed of said engine when said engine is attempting to exceed a first predetermined speed, said rotating speed setting means limiting the speed of said engine to said first predetermined speed for a predetermined interval of time while said engine is attempting to exceed said first predetermined speed and thereafter limiting the speed of said engine to a second predetermined speed which is less than said first predetermined speed;

wherein said engine includes a spark plug and capacitive discharge ignition means coupled to said spark plug for periodically applying to said spark plug an electrical voltage pulse which causes said spark plug to produce a spark;

wherein said rotating speed setting means includes selectively actuable suppression means for inhibiting the application of selected said electrical voltage pulses to said spark plug in order to effect said limiting of the rotating speed of said engine;

wherein said rotating speed setting means further includes spark extinction detecting means for producing a signal indicating that said suppression means is inhibiting electrical voltage pulses in order to limit the rotating speed of said engine, timer means responsive to said spark extinction detecting means for measuring said predetermined interval of time after said spark extinction detecting means produces said signal, and rotating speed switching circuit means responsive to said timer means for causing said suppression means to selectively inhibit the application to said spark plug of more of said electrical voltage pulses in order to effect said limiting of the rotating speed of said engine to said second predetermined speed;

including first switch means for producing a first signal when insufficient coolant is supplied to a water jacket of said engine and second switch means for producing a second signal when the level of a lubricating fluid in the engine drops below a predetermined level;

including means for producing an operator perceptible warning in response to one of said first and second signals, said means for producing an operator perceptible warning being one of a buzzer and a light emitting diode; and wherein said first switch means includes an electrode disposed in said water jacket of said engine so as to be in contact with coolant flowing through said water jacket and so as to be insulated from said water jacket, the resistance between said electrode and said water jacket being lower when coolant in said water jacket is contacting said electrode and said water jacket than when said electrode is free of contact with coolant, and means for producing said first signal when the electrical resistance between said electrode and said water jacket is greater than a predetermined value.

16. The warning apparatus according to claim 15, including a body which is sealingly supported in an opening through a wall of said water jacket and which has an opening therethrough, and an electrode holder disposed in said opening through said body, said electrode holder being made of an insulating material and having said electrode extending therethrough.

17. A warning apparatus according to claim 16, including a filler member disposed in said opening through said body on a side of said electrode holder remote from the coolant, said electrode extending through said filler member.

* * * * *